US009038556B2

(12) United States Patent
Ulgen

(10) Patent No.: US 9,038,556 B2
(45) Date of Patent: May 26, 2015

(54) FENDER ASSEMBLY FOR BOATS

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 187 days.

(21) Appl. No.: 13/664,274

(22) Filed: Oct. 30, 2012

(65) Prior Publication Data

US 2013/0152842 A1 Jun. 20, 2013

(30) Foreign Application Priority Data

Dec. 14, 2011 (TR) ..... u 2011 12395

(51) Int. Cl.
*B63B 59/02* (2006.01)

(52) U.S. Cl.
CPC ..... *B63B 59/02* (2013.01)

(58) Field of Classification Search
CPC ..... B63B 59/02; B63B 2059/02; B63B 2059/025; E02B 3/26; E02B 3/28
USPC ..... 114/219, 220; 405/212–215
See application file for complete search history.

(56) References Cited

U.S. PATENT DOCUMENTS

| | | | | | |
|---|---|---|---|---|---|
| 3,106,182 | A * | 10/1963 | Burleigh | ..... | 114/220 |
| 3,528,383 | A * | 9/1970 | Fetters | ..... | 114/220 |
| 3,890,917 | A * | 6/1975 | Ackroyd et al. | ..... | 114/220 |
| 4,351,257 | A | 9/1982 | Brown, Jr. | | |
| 6,161,494 | A * | 12/2000 | Pontevolpe et al. | ..... | 114/219 |
| 2011/0239925 | A1 * | 10/2011 | Kim | ..... | 114/219 |

FOREIGN PATENT DOCUMENTS

| | | | | |
|---|---|---|---|---|
| FR | 2810624 | A1 * | 12/2001 | ..... B63B 7/02 |
| JP | 05039085 | A * | 2/1993 | ..... B63B 59/02 |
| WO | 2010/085200 | A1 | 7/2010 | |
| WO | 2010/122366 | A1 | 10/2010 | |

* cited by examiner

*Primary Examiner* — Ajay Vasudeva
(74) *Attorney, Agent, or Firm* — Vidas, Arrett & Steinkraus

(57) ABSTRACT

A concealable fender assembly comprising a fender; a cover having an external surface form compatible with the lateral surface form of the boat hull in closed position; mechanism for actuating the cover for closing and opening thereof with respect to the boat hull lateral surface; wherein the cover is associated with the fender such that when the cover is in open position, the fender outwardly extends from boat hull lateral surface.

6 Claims, 7 Drawing Sheets

FENDER ASSEMBLY FOR BOATS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a concealable fender assembly for boats.

Typically made of rubber or plastic material, fenders are usually used for protecting the sides of the boats when they come alongside each other or dock against scratches and collapses.

Fenders are kept on the deck of the boat during cruising and suspended vertically in water by a person from the side through the protruding areas thereof before docking and tied to the appropriate places on the deck, and they are picked up again during cruising. Known boat fender arrangements include drawbacks in terms of many aspects. For example, the time period for taking the fender from the place where it is stored may sometimes be very short and this leads the user to decide instantaneously what correct spot that the fender should be tied. Apart from this, the user is usually required to untie the fenders and transfer thereof that are not required any longer to the respective storage places, which may need a lot of effort depending on the number and the size of the fenders.

BRIEF SUMMARY OF THE INVENTION

The object of the present invention is to make the fenders readily available for boats in the most effective way.

The above object is achieved by a concealable fender assembly comprising a fender;

a cover having an external surface form compatible with the lateral surface form of the boat hull in closed position;

mechanism for actuating the cover for closing and opening thereof with respect to the boat hull lateral surface;

wherein the cover is associated with the fender such that when the cover is in open position, the fender outwardly extends from boat hull lateral surface.

The concealable fender assembly according to an embodiment of the present invention further comprises a plurality of rollers partially surrounding the rear side of the fender, i.e. the side being rear to the side facing to other boats or docks. The rollers are supported by spring elements at their bottom ends against lateral swings.

The concealable fender assembly according to an embodiment of the present invention further comprises an elastic cord adjusting the fender for being rested against the rollers by adjusting a free vertical angle between the fender and the vertical direction. The cord is connected with the fender through the lower part thereof and a lever arm provided on the upper portion of a shaft rotating the cover designed for being able to pull the cord inside.

BRIEF DESCRIPTION OF THE SEVERAL VIEWS OF THE DRAWINGS

The embodiment of the present invention and the advantages thereof with the additional components must be considered together with the figures explained below in order to be fully understood.

DETAILED DESCRIPTION OF THE INVENTION

Figure 1:
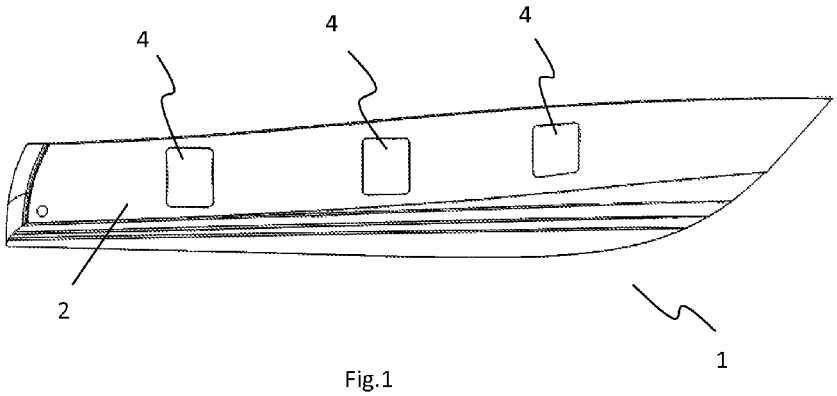
FIG. 1 is the side view of the boat, with the fender concealed.
Figure 2:
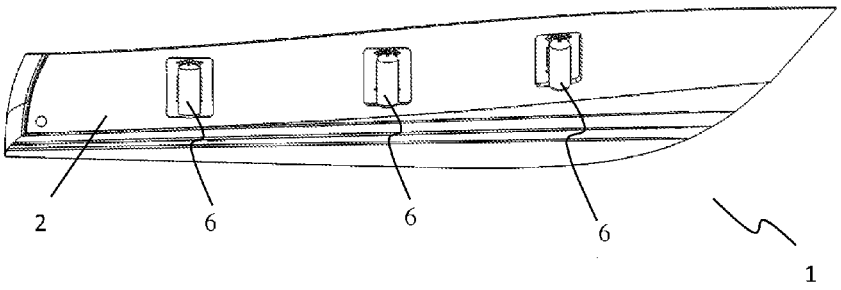
FIG. 2 is the side view of the boat, with the fender opened.
Figure 3:
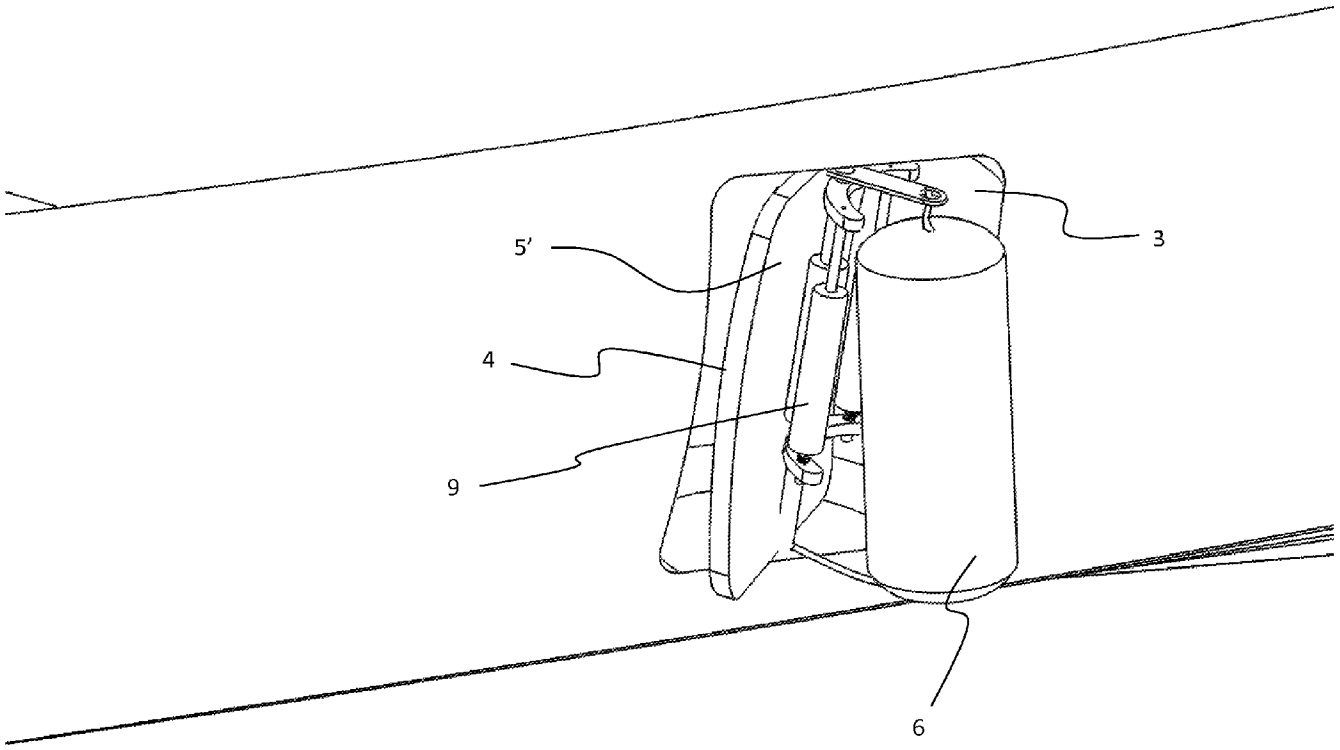
FIG. 3 is the view showing the fender during opening from the concealed position thereof
Figure 4:
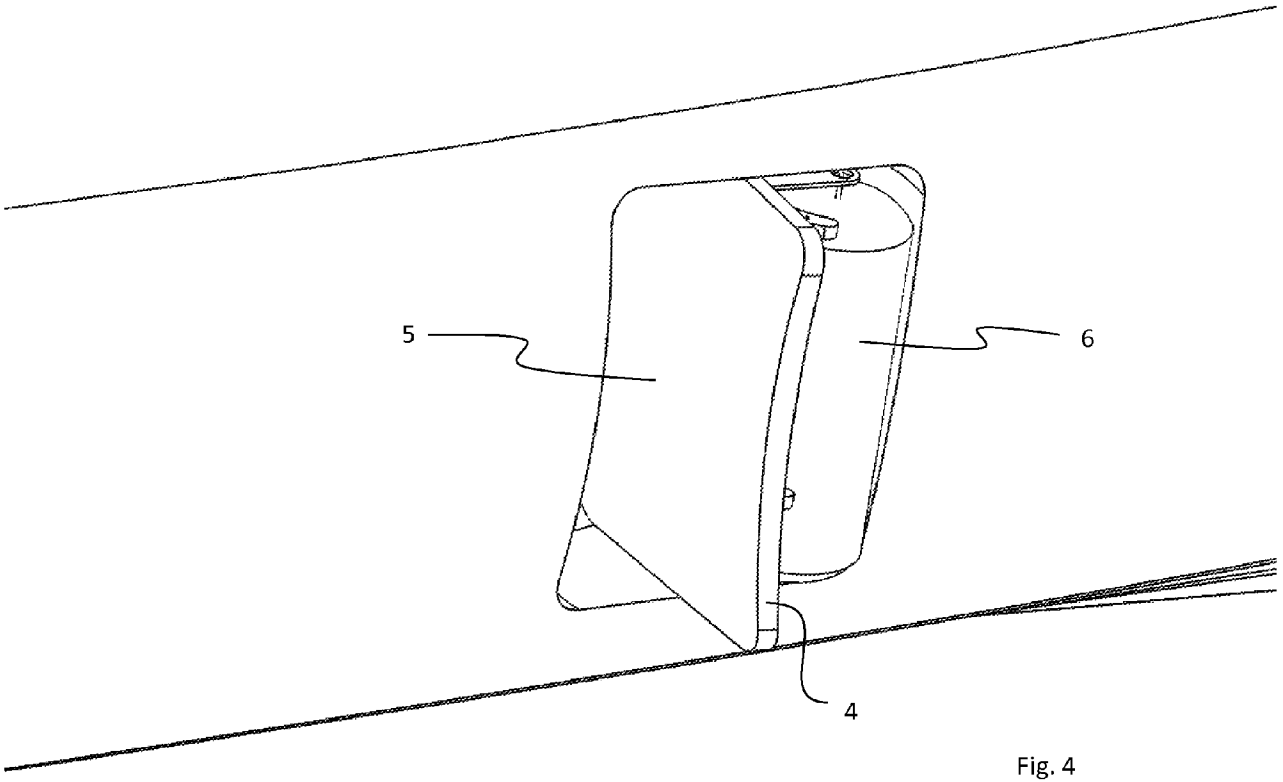
FIG. 4 is the view showing the fender assembly during transition from an open position to the concealed position thereof.
Figure 5:
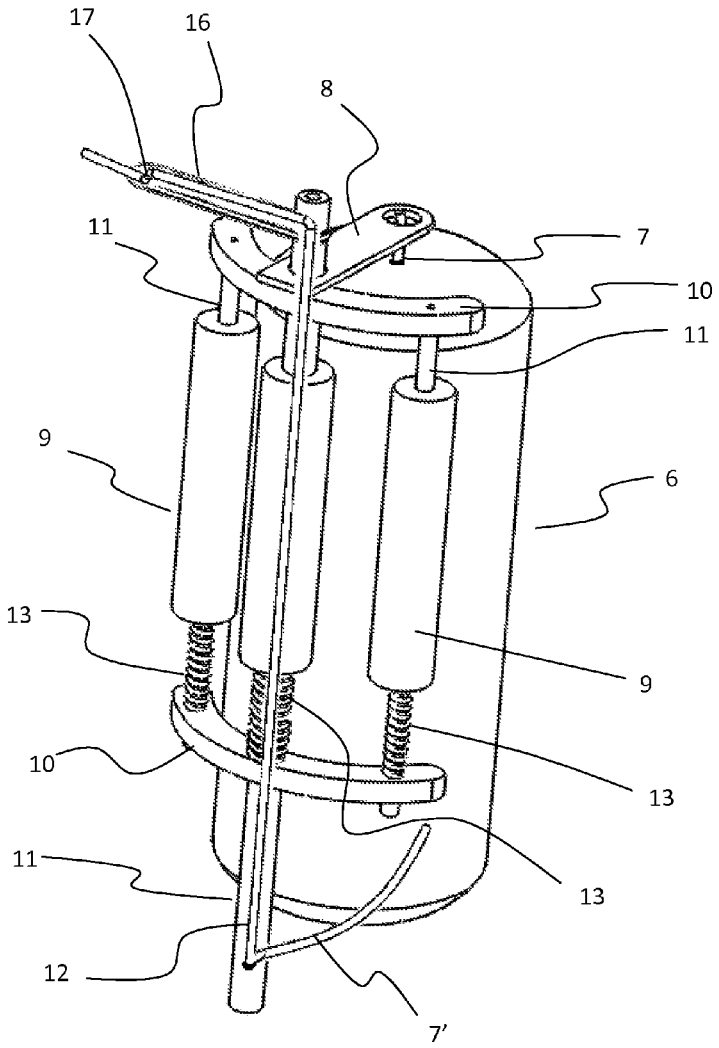
FIG. 5 is the perspective rear view of the fender assembly according to the present invention, without cover.
Figure 6:
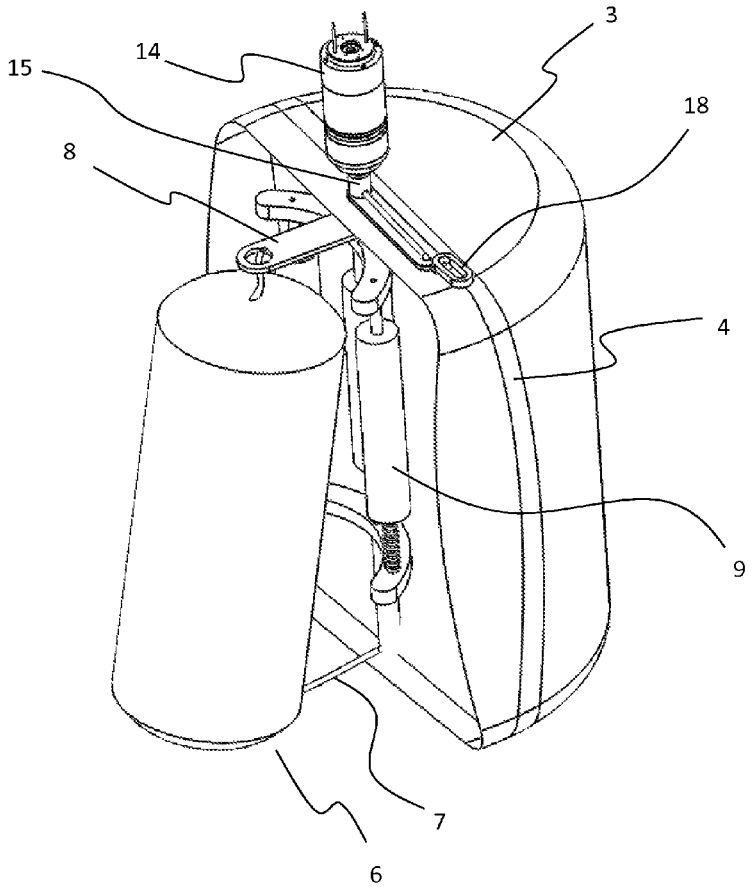
FIG. 6 is another perspective front view of the open fender assembly according to the present invention with the motor, boat cords of which are concealed.
Figure 7:
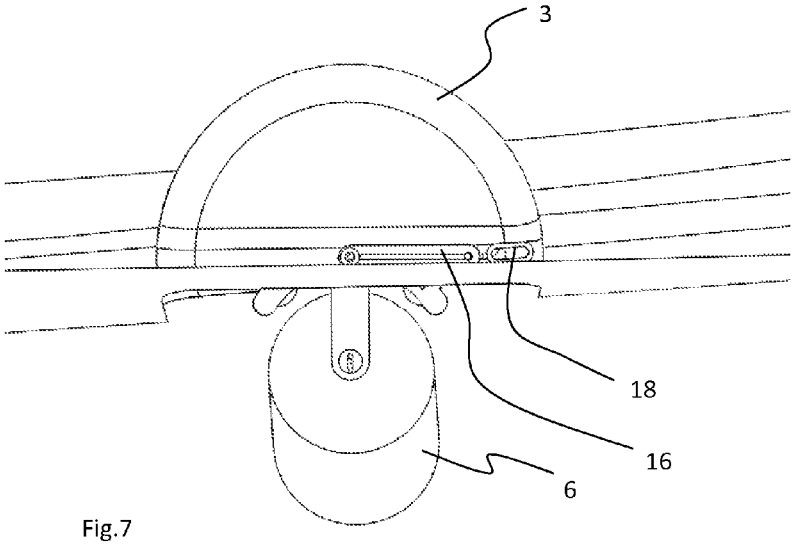
FIG. 7 is the top view of the open fender.
Figure 8:
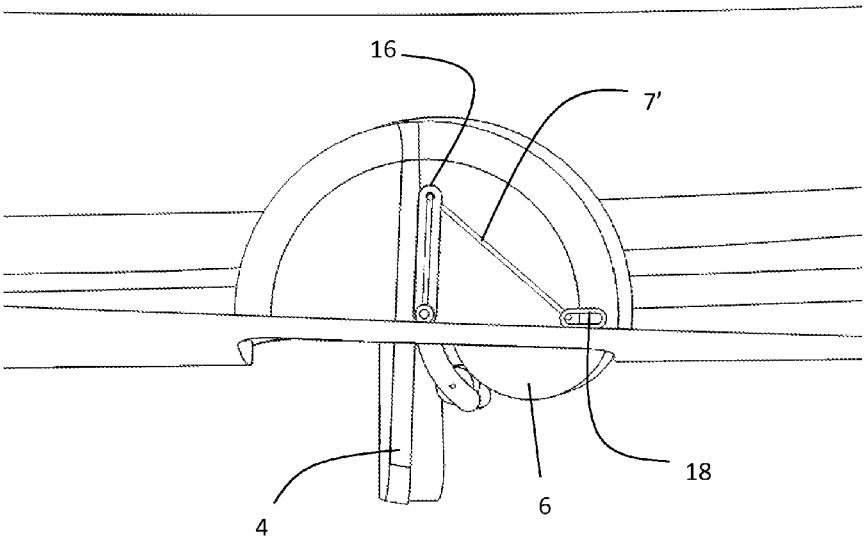
FIG. 8 is the top view showing opening of the fender.
Figure 9:
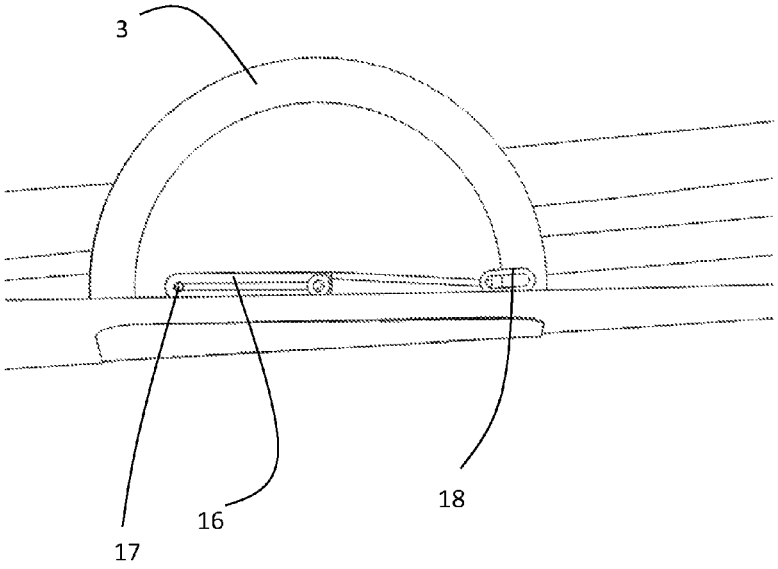
FIG. 9 is the top view of the closed fender.

While this invention may be embodied in many different forms, there are described in detail herein a specific preferred embodiment of the invention. This description is an exemplification of the principles of the invention and is not intended to limit the invention to the particular embodiment illustrated Throughout this description, it should be considered that the term 'boat' refers to all types of marine vessels where utilization of fender is possible or would be possible. Concealable fender assembly according to the present invention is arranged so as to function on the lateral surfaces (2) of the boat hull (1). The concealable fender assembly of the invention comprises an openable and closeable cover (4) provided on the lateral surface or surfaces (2) of the boat hull. The cover (4) is associated with the fender (6), and when the cover is opened, the fender (6) opens outward from the hull lateral surface (2), and when said cover is closed, said fender is concealed to the eye looking at the boat from outside.

The cover outer surface (5) has a form compatible with the boat's lateral surface (2). Thus, when the cover (4) is closed, perfect (continuous and flush with) lateral surface form of the boat is maintained. The fender (6), when assembled, faces the inner surface (5') of the cover (4). However, when the cover (4) is closed, a housing (3) is arranged in the inner part of the hull for concealing the fender (6). The housing (3) is preferably in the form of a cylindrical case and is arranged on the boat hull (1) in a water-tight manner. The cover (4), as described below, is connected rotatably inside the cylindrical case formed as housing (3).

The fenders (6) are semi-cylindrical in form and conventionally are suspended downward from the side of the boat such that cylinder axis is provided in the vertical direction. Considering this point, the cover (4) of the assembly according to the present invention is preferred to be rotated around an axis in the vertical direction for facilitating the execution of the present invention. However, said cover (4), if required, can also be rotated around a horizontal axis with respect to the fender (6) connection configuration.

A mechanism for actuating the cover is connected to a motor shaft (15) rigidly connected to the inner or top edge of the cover (4) (e.g. through welding etc.) and extending in the vertical direction such that the motor can rotate 180° about the shaft (15). This mechanism for actuating is preferably a motor (14) which can be selected as a stepper motor, as well as a conventional motor where 180° rotation of the cover can be controlled through switches arranged on the opposite sides of the cover and boat hull. The cover (4) may be mounted on the boat hull through the lower edge thereof by a conventional rotary bearing (not shown in figures). Certainly, it will be appreciated that the positions of the motor and said rotary bearing can be changed (i.e. such that the motor is provided in the lower part, while bearing is provided in the upper part).

In order to connect the fender (6) with the cover (4), a cord connecting arm (8) extending horizontally from the cover inner surface (5') towards the inner part of the boat hull is provided. The cord connecting arm (8), in terms of the height thereof, is provided above the fender (6). Preferably, a cord (7) made of an elastic material is connected to said connecting arm (8) at one end, and to the fender (6) at the other end. Thus, the fender (6) is connected with the cover (4) through upper part thereof by said cord (7). Another cord (7) is connected thereto through the lower part of the fender (6); the connection of the other elastic cord (7') on the cover (4) side will be described below.

A plurality of rollers (9) extending vertically between the fender (6) and the cover (4) is provided. The fender (6) rests against said rollers (9) when it comes into contact with an external object (boat, dock, etc.). The rollers (9) are mounted by means of the roller bearing shafts (11) along the axes thereof in such a way that said rollers can rotate on the outer surfaces of said shafts. Thus, the fender (6) can easily rotate around its axis by means of the rotating rollers (9) and therefore wearing of the fender during contact with an external object is avoided. The rollers (9) surround the fender (6) during contact through rear side thereof and preferably up to 120°.

According to an embodiment of the present invention, the rollers (9) are three in number and the said rollers are arranged in the vertical direction so as to be provided with a certain distance in between them and to define an arcuate array form when they are arranged so as to suit external cylindrical form of the fender (6).

Roller bearing shafts (11) bearing the rollers (9) are connected to a roller shaft support (10) through the lower and upper parts thereof. Optionally, a spring (13) can be placed between each roller (9) end part and the roller shaft support (10). Prevention of the lateral swings of the rollers (9) during contact of the fender (6) with an external object becomes possible thanks to said springs (13). According to the preferred embodiment of the present invention, springs (13) are preferably placed in the lower part of the rollers (9). However, optionally, springs (13) can also be placed between each roller (9) end part and the roller shaft support (10), between both end parts.

One of the roller bearing shafts (preferably the one in the middle) extends upward from the roller shaft support (10) provided in the upper part, and thus said extension assumes the function of motor shaft (15). The roller bearing shaft provided in the middle extends downward from the roller shaft support (10) provided in the lower part. The cord (7') connected at one end thereof to the lower part of the fender (6) is inserted into a cord channel (12) coaxially formed inside/along the roller bearing shaft (11) and conveying of said cord upward through said channel (12) is provided, then, said cord (7') exits the roller bearing shaft (11). A lever arm (16) provided in the upper part of the motor shaft (15) and extending outward from said shaft in a radial direction is formed to be able to pull said exiting cord (7') into the boat hull (1). By means of this lever arm (16), following are provided: pulling the fender (6) into the boat hull (1) when the cover (4) is closed and taking the fender (6) out of the boat hull (1) when the cover (4) is opened. The cord (7') stepping out the roller bearing shaft (11) is conveyed through the lever arm (16), is passed through a hole (17) opened on farther end of the lever arm (16) from the motor shaft (15) and is directed to a ring (18) positioned over the housing (3) for passing through it. In the event that the cover (4) is completely closed, farther end of the lever arm (16) from the motor shaft (15), when viewed from the top, horizontally faces left according to the embodiment in the figures and in the event that the cover (4) is completely opened, farther end of the lever arm (16) from the motor shaft (15) horizontally faces right. In other words, the lever arm (16) can perform a displacement of 180° for pulling the fender (6) into the boat hull (1) or taking said fender out of said place.

Said exiting cord (7') can be used for the position control of the fender (6). As a matter of fact, according to an embodiment of the present invention, if the cord (7') provided in the lower part of the fender (6) is united with the cord (7) provided in the upper part (in a single piece or if said cords are connected to each other), the fender (6) moves upward when the cord (7') provided in the lower part is stretched, and thus a safer cushioning based on the form of the external object can be provided. If the cord (7') is released, the fender (6) moves downward and a cushioning suitable for this situation can be provided.

This completes the description of the preferred and alternate embodiments of the invention. Those skilled in the art may recognize other equivalents to the specific embodiment described herein which equivalents are intended to be encompassed by the claims attached hereto.

What is claimed is:

1. A concealable fender assembly for a boat hull comprising:

a fender (6);

a cover (4) having an external surface (5) form compatible with a lateral surface (2) form of the boat hull (1) in closed position;

a cover actuating mechanism for actuating the cover (4) for closing and opening thereof with respect to the boat hull lateral surface (2);

wherein the cover (4) is associated with the fender (6) such that when the cover (4) is in open position, the fender (6) outwardly extends from boat hull lateral surface (2);

further comprising a plurality of rollers (9) extending between the fender (6) and the cover (4); and further comprising a spring (13) placed between each roller (9) end part and a roller shaft support (10).

2. A concealable fender assembly for a boat hull comprising a fender (6);

a cover (4) having an external surface (5) form compatible with a lateral surface (2) form of the boat hull (1) in closed position;

a cover actuating mechanism for actuating the cover (4) for closing and opening thereof with respect to the boat hull lateral surface (2);

wherein the cover (4) is associated with the fender (6) such that when the cover (4) is in open position, the fender (6) outwardly extends from boat hull lateral surface (2); and further comprising a plurality of rollers (9) extending between the fender (6) and the cover (4);

further comprising a cord connecting arm (8) extending horizontally from an inner surface (5') of the cover (4) towards an inner part of the boat hull; and further comprising a cord (7) connected to the connecting arm (8) at one end and to the fender (6) at the other end.

3. A concealable fender assembly for a boat hull comprising a fender (6);

a cover (4) having an external surface (5) form compatible with a lateral surface (2) form of the boat hull (1) in closed position;

a cover actuating mechanism for actuating the cover (4) for closing and opening thereof with respect to the boat hull lateral surface (2);

wherein the cover (4) is associated with the fender (6) such that when the cover (4) is in open position, the fender (6) outwardly extends from boat hull lateral surface (2); and further comprising a plurality of rollers (9) extending between the fender (6) and the cover (4);

further comprising a cord connecting arm (8) extending horizontally from an inner surface (5') of the cover (4) towards an inner part of the boat hull; and further comprising a cord (7') connected to a lower part of the fender (6).

4. An assembly according to claim 3, further comprising a cord channel (12) coaxially formed along a roller bearing shaft (11) for passing said cord (7') connected to the lower part of the fender (6) therethrough.

5. An assembly according to claim 3, wherein the cord (7) connected to the upper part of the fender (6) and the cord (7') connected to the lower part of the fender (6) are combined.

6. A concealable fender assembly for a boat hull comprising a fender (6);

a cover (4) having an external surface (5) form compatible with a lateral surface (2) form of the boat hull (1) in closed position;

a cover actuating mechanism for actuating the cover (4) for closing and opening thereof with respect to the boat hull lateral surface (2);

wherein the cover (4) is associated with the fender (6) such that when the cover (4) is in open position, the fender (6) outwardly extends from boat hull lateral surface (2); and further comprising a plurality of rollers (9) extending between the fender (6) and the cover (4);

further comprising a cord connecting arm (8) extending horizontally from an inner surface (5') of the cover (4) towards an inner part of the boat hull; and further comprising a lever arm (16) connected to a cord (7'), the cord (7') is connected to the lower part of the fender (6), provided in the upper part of a shaft (15) connected to a motor (14) and extending outward from said shaft for pulling the fender (6) into the boat hull (1) when the cover (4) is closed and taking the fender (6) out of the boat hull (1) when the cover (4) is opened.

* * * * *